United States Patent [19]

Hsieh

[11] Patent Number: 4,976,181

[45] Date of Patent: Dec. 11, 1990

[54] MEANS FOR REGULATING CYMBAL PEDAL TIGHTNESS

[76] Inventor: Wu H. Hsieh, No. 178, Chung Shan Ehr Rd., Lu Chou, Hsiang, Taipei Hsien, Taiwan

[21] Appl. No.: 500,743

[22] Filed: Mar. 28, 1990

[51] Int. Cl.[5] ..... G10D 13/00

[52] U.S. Cl. ..... 84/422.3

[58] Field of Search ..... 84/422.1, 422.3

[56] References Cited

U.S. PATENT DOCUMENTS

| | | | |
|---|---|---|---|
| 2,828,660 | 4/1958 | Paulsen | 84/312 R |
| 3,530,757 | 9/1970 | Osuga | 84/422.3 |
| 4,449,440 | 5/1984 | Hoshino | 84/422.3 |
| 4,846,040 | 7/1989 | Hoshino | 84/422.3 |

*Primary Examiner*—Lawrence R. Franklin

*Attorney, Agent, or Firm*—Fitch, Even, Tabin & Flannery

[57] ABSTRACT

A means for maintaining cymbol pedal tightness includes a fixed fitting to which both a cymbol pedal is attached and to either end of which a spring fitting is attached. The other end of each spring fitting is attached to an adjusting fitting. The adjusting fitting is fixably disposed directly above the pedal. A depression of the cymbol pedal pulls downwardly on the fixed fitting causing the springs in the spring fitting to extend. A subsequent release of the pedal releases the tension on the springs allowing the pedal to return to its original position. The tension in the springs is adjustable by means of gears disposed within the adjusting fitting.

3 Claims, 4 Drawing Sheets

MEANS FOR REGULATING CYMBAL PEDAL TIGHTNESS

BACKGROUND OF THE INVENTION

This invention relates to musical cymbals, and, more particularly, to a means for maintaining the tightness in the pedal by which the cymbals are operated.

Conventionally, the tightness in the pedal is maintained by a means as shown in FIG. 4. The pedal 10 is connected by means of a pedal chain 91 to a lower draw bar 62. An upper end of the draw bar 62 connects with a coupling block 80 to which a lower end of an upper draw bar 64 is also connected. A depression of the pedal 10 subsequently causes the upper draw bar, to an upper end of which is attached a top cymbal, to rapidly descend causing the top cymbal (not shown) to crash down on the bottom cymbal (also not shown) producing the appropriate musical effect. Therefore, when at rest, the pedal 10 is raised slightly above the ground, so that the cymbals can be operated by a tap of the foot. Conventionally, such means for holding the pedal 10 slightly above the ground, as well as maintaining a certain amount of tautness in the pedal, is provided in the form of a spring-loaded mechanism. With reference again to FIG. 4, one end of a spring 61 is connected to the coupling block 80 and the other end to an end block 71. The upper draw bar 64, disposed within the central hollow of the spring 61, extends up through the end block 71. When the pedal is depressed, the spring 61 stretches downwardly along with the coupling block 80; however, when the pedal is released, the spring 61 retracts back causing the coupling block 80, and consequently, the pedal 10, to rise.

The particular tautness in the pedal, as well as the height of the pedal above the ground is of interest to the musician who is concerned, not only with the musical integrity of the percussional sound, but also with the "feel" of the instrument. Therefore, the height of the end block 71 above the coupling block 80 is conventionally adjustable in order to regulate the tension in the spring 61. The tube 60 is, therefore, provided with two diametrically opposed slots 63 through which each end of the end block 71 extends. V-type screw threads 72 are provided on the tube 60 in the region of the slots 63. A adjusting block 70, within which both ends of the end block 71 rest, is engageable with the threads 72 such that the end block 71 is raised or lowered by twisting the adjusting block 70.

Although the "feel" of the pedal is thereby maintained by adjustments to the tension in the spring 61, the prior art possesses four very distinct drawbacks. First, the threading 72 is left exposed to the elements and therefore is easily clogged with dust. Also a user's fingers are easily injured on the threading during adjustment of the end block 71. Furthermore, the slots 63 formed in the tube 60 in the region of the threading 62 cause discontinuities in the threading 62. The threading provided on the inner surface of the adjusting block 70, therefore, does not properly engage with the threading 62 and can grate against the threading 62 causing wear. Moreover, because the adjusting block 70 is also subject to the rather substantial forces applied to the end block 71 due to depression of the pedal, additional stress is placed on the threading 62 causing additional erosion.

It is the purpose of this present invention, therefore, to mitigate and/or obviate the above-mentioned drawbacks in the manner set forth in the detailed description of the preferred embodiment.

SUMMARY OF THE INVENTION

It is accordingly a primary objective of the present invention to provide a means for regulating cymbal pedal tightness where all screw threading is protected and not left exposed to the elements.

It is a further objective of the present invention to provide a means for regulating a cymbal pedal tightness which is convenient to use.

It is a further objective of the present invention to provide a means for regulating a cymbal pedal tightness which is of rugged design.

It is a further objective of the present invention to provide a means for regulating a cymbal pedal tightness which is of sturdy construction.

It is a further objective of the present invention to provide means for regulating a cymbal pedal tightness which protects the musician from injury.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
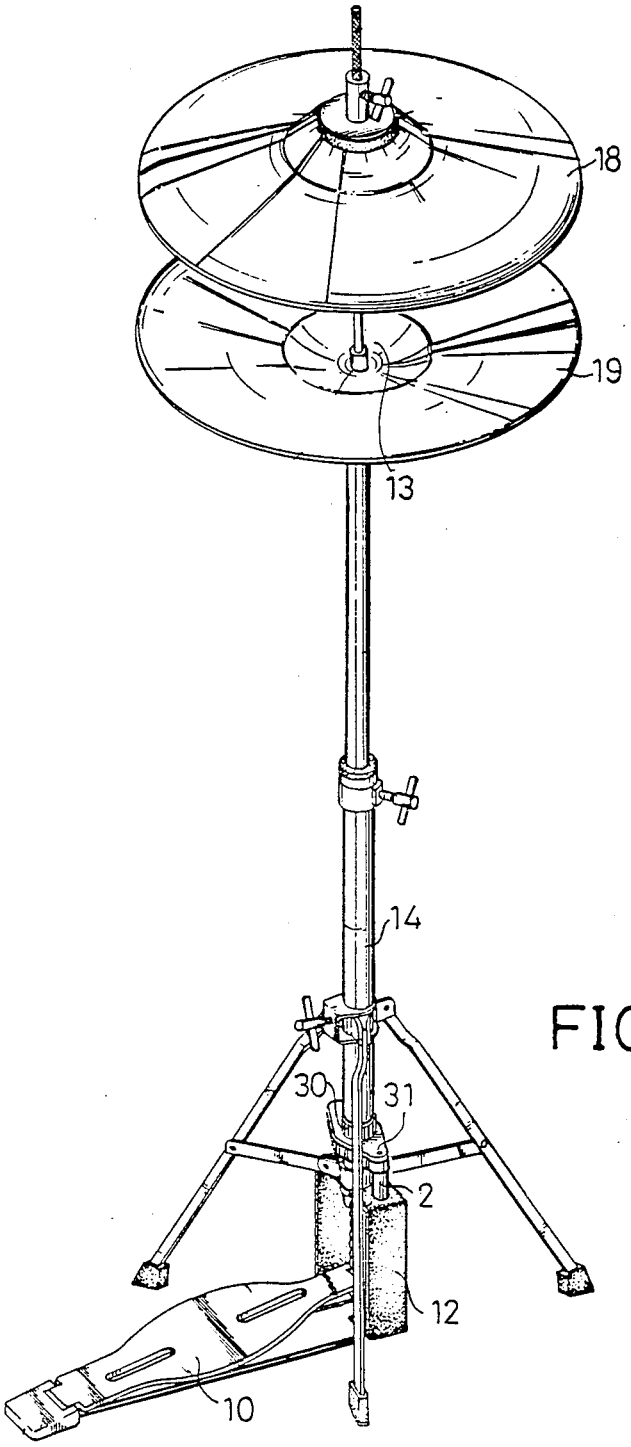
FIG. 1 is a perspective view of musical cymbals fitted with the means for maintaining tightness in the pedal in accordance with the present invention.

With reference to the drawings and initially to FIG. 1, it can be seen that musical cymbals fitted with the means for maintaining cymbal pedal tightness of the present invention includes a pedal 10 disposed under a base 12, the end of the pedal disposed directly under the base 12 being raised slightly above the ground. The pedal 10 is connected to a draw rod 13 disposed within a tube 14 which extends upwardly through the tube 14 and to an end thereof is attached an upper cymbal 18. The cymbol pedal 10 is operated by a tap of the foot which causes the draw rod 13 to rapidly lower causing the upper cymbal 18 to crash down on the lower cymbal 19 creating the appropriate percussional effect.

Upon release of the pedal 10, the pedal 10 must return to an original position thereof causing the draw rod 13, and consequently, the upper cymbal 18 to be raised. An appropriate restorative force is therefore applied to the pedal 10 and draw rod 13 configuration by the means for maintaining cymbal pedal tightness of the present invention which includes an adjusting ring 30 disposed around the tube 14. Disposed directly below the adjusting ring 30 is a gear housing 31. Two spring 40 disposed beneath the gear housing connect with the pedal 10.

Figure 2:
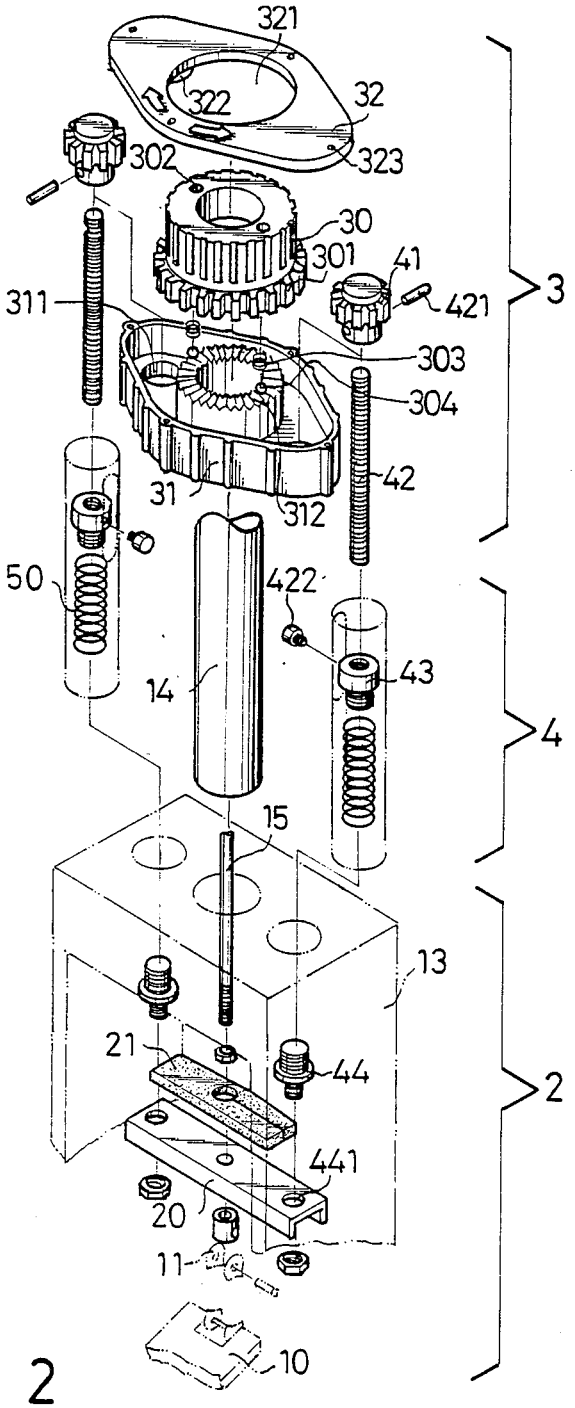
FIG. 2 is an exploded view of means for maintaining tightness in a pedal for musical cymbals in accordance with the present invention.

FIG. 2 shows the inner workings of the means for maintaining cymbal pedal tightness of the present invention. An end of the pedal 10, disposed beneath the base 12, is connected by means of a pedal chain 11 to the draw rod 13. The draw rod 13 extends upwardly through a central portion of a fixed plate 20 and setting foam 21 disposed thereon. The draw rod 13 continues to extend upwardly through the tube 14 and through the gear housing 30 of the adjusting means fitting 3.

The function of the adjusting means fitting 3 is two-fold. First, the adjusting means fitting 3 is stably positioned on a lower portion of the tube 14. Springs 40, which provide the restorative force in the means for maintaining cymbal pedal tightness of the present invention, are connected at one end thereof to the adjusting means fitting 3 and at another end thereof to the fixed fitting 2. Second, the adjusting means fitting 3 is provided with an adjusting ring 30 by means of which the tension in the springs 40 is regulated.

The adjusting means fitting 3 includes a housing 31 formed with a through hole 311 on either end thereof. Into each through hole 311 and within the housing 31 is disposed a small toothed gear 41. A threaded stabilizing rod 42 screwably fixes at an end thereof within the small gear 41. A pin 421 secures the connection.

The other end of the stabilizing rod 42 screwably fixes within a coupling block 43. A pin 422 is secured to each coupling block 43 and extends into a guide slot in the wall of each tube 45. When threaded rod 42 is rotated, pin 422 acts as a key within the slot to prevent coupling block 43 from rotating. Coupling block 43 is forced to move upwardly or downwardly on threaded rod 42, depending on the direction of rotation of rod 42. To a lower end of the coupling block 43 is fixedly connected an end of the spring 40. The other end of the spring 40 is also fixedly connected to a fixing screw 44 which is mounted on the fixing plate 20 by means of a bolt 441.

A depression of the pedal 10 therefore pulls down on the fixing plate 20 which in turn pulls down on both the draw rod 13 causing the cymbals to crash and also pulls down on the springs 40. A tension is therefore stored in the extended springs 40 which acts as a restorative force to raise the pedal 10 back to an original position thereof upon release.

The tension in the springs 40 is adjustable by means of the adjusting ring 30 of the adjusting fitting 3. The toothed base 301 of the adjusting ring 30 is engageable with both the small gears 41. A rotation of the adjusting ring 30 translates to both the small gears 41. Each stabilizing rod 42 is securably fixed within each respective small gear 41. A rotation of each small gear 41 therefore causes each stabilizing rod 42 to rotate within a respective corresponding coupling block 43 thereby adjusting the tension in each respective spring 40.

The adjusting ring 30 is formed with two through holes 302 within each of which is disposed a small buffering spring 303 and a ball bearing 304. The ball bearing 304 rest within V-type teeth 312 provided within the housing 31 on a seat 313 for the adjusting ring 30. A rotational adjustment of the adjusting ring 30 is therefore secured by means of the ball bearing 304 resting within the V-type teeth 312.

A cover 32 formed with a through hole 321 through which the adjusting ring 30 protrudes is also formed on an underside at either end thereof with a seat 322 for stabilizing a position within the housing 31 of each respective small gear 41.

Figure 3:
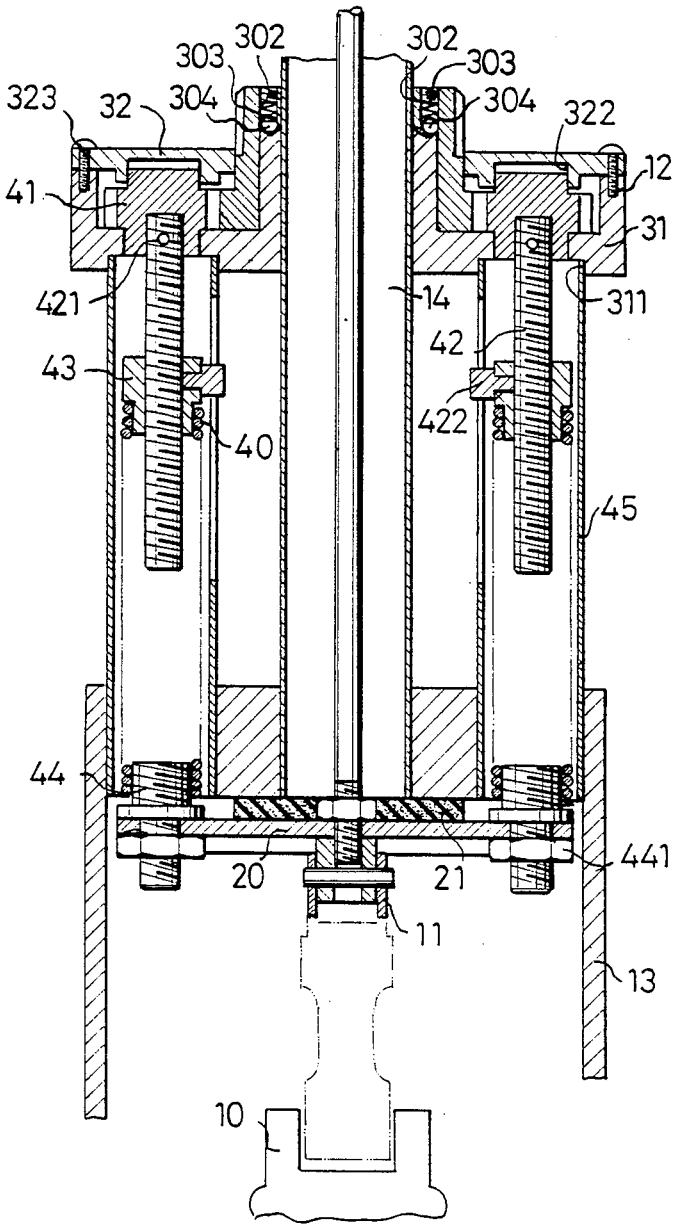
FIG. 3 is a cross-sectional side view of FIG. 2.
Figure 4:
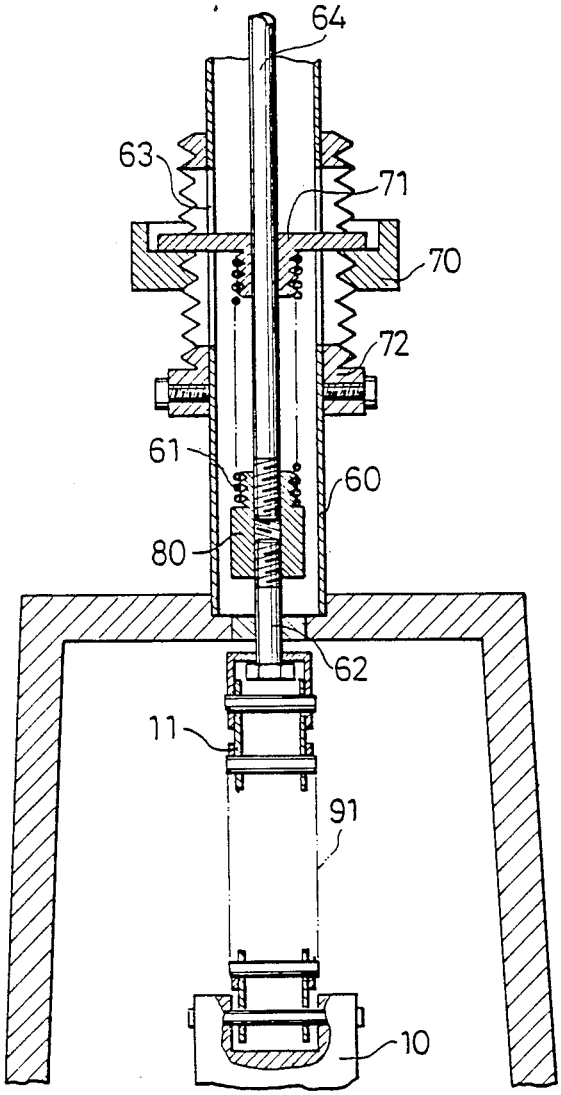
FIG. 4 Prior Art
FIG. 4 is a prior art.

The means for maintaining cymbal pedal tightness, as shown in FIG. 3, is therefore self-contained so as to be protected from dust and so as to guard against injury of a user. The means for maintaining cymbal pedal tightness of the present invention ensures ease in adjustment of the tension in the springs 40 for regulating the "feel" in the cymbal pedal. The present invention is also of sturdy and lasting construction so as to ensure the musical integrity of the percussional sound.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A means for adjusting and maintaining cymbal pedal tightness, comprising:

a base adapted to rest on a support surface;

a first tube connected at one end to said base and supporting a lower cymbal, said first tube have a housing fixed thereto intermediate its ends;

a draw rod connected at one end to an upper cymbal, said draw rod extending through said first tube and having its other end fixed to a plate;

a pedal connected to said plate such that depression of said pedal causes said plate and draw rod to descend causing said upper cymbal to crash down on said lower cymbal creating an appropriate percussional effect, the improvement comprising:

a pair of tubes connected at one end to said base and at the other end to said housing, each of said pair of tubes having a slot therein;

an adjusting ring have gear teeth thereon;

a pair of small, toothed gears engageable with said adjusting ring gear teeth;

each of said small, toothed gears having a threaded rod fixedly connected thereto and extending into one of said pair of tubes;

a coupling block rotatably threaded onto each of said threaded rods, said coupling block having a pin thereon extending into one of said slots; and a pair of springs, each having one end fixed to one of said coupling blocks and the other end fixed to said plate.

2. The means of claim 1 wherein said housing includes a seat having V-type teeth thereon, and a pair of spring-loaded ball bearings mounted in said adjusting ring to ride on said V-type teeth for securing said adjusting ring stably in selected positions.

3. The means of claim 1 wherein the gear teeth of said adjusting ring and said pair of gears are housed in said housing, the remainder of said adjusting ring extending outside of said housing.

* * * * *

UNITED STATES PATENT AND TRADEMARK OFFICE

CERTIFICATE OF CORRECTION

PATENT NO. : 4,976,181

DATED : December 11, 1990

INVENTOR(S) : Wu Hung Hsieh

It is certified that error appears in the above-identified patent and that said Letters Patent is hereby corrected as shown below:

ON TITLE PAGE of the Patent in the Inventor's address, second line, change "Ehr" to --Erh--.

On the Face of the Patent, in line 1 of the Abstract, change "cymbol" to --cymbal--.

On the Face of the Patent, in line 2 of the Abstract, change "cymbol" to --cymbal--.

On the Face of the Patent, in line 7 of the Abstract, change "cymbol" to --cymbal--.

Column 1, line 47, change "A" to --An--.

Column 2, line 19, after "provide" insert --a--.

Column 2, line 61, change "spring" to --springs--.

Column 3, line 52, change "bearing" to --bearings--.

Column 3, line 56, change "bearing" to --bearings--.

Column 4, line 26, change "have" to --having--.

Column 4, line 39, change "have" to --having--.

Signed and Sealed this

Fourth Day of August, 1992

*Attest:*

DOUGLAS B. COMER

*Attesting Officer*

*Acting Commissioner of Patents and Trademarks*